US006117607A

United States Patent [19]

Shimizu et al.

[11] Patent Number: 6,117,607

[45] Date of Patent: Sep. 12, 2000

[54] FULL COLOR TONER FOR NONMAGNETIC ONE-COMPONENT DEVELOPMENT

[75] Inventors: Jun Shimizu; Hidenori Tachi; Masayuki Maruta, all of Wakayama, Japan

[73] Assignee: Kao Corporation, Tokyo, Japan

[21] Appl. No.: 08/946,699

[22] Filed: Oct. 8, 1997

[30] Foreign Application Priority Data

Oct. 11, 1996 [JP] Japan ..... 8-289145

[51] Int. Cl.[7] ..... G03G 9/097

[52] U.S. Cl. ..... 430/110; 430/109

[58] Field of Search ..... 430/110, 109, 430/106

[56] References Cited

U.S. PATENT DOCUMENTS 5,827,632 10/1998 Inaba et al. ..... 430/110

FOREIGN PATENT DOCUMENTS 3-125157 5/1991 Japan .
8-123073 5/1996 Japan .

OTHER PUBLICATIONS

English translation of JP 3–125157, May 1991.
English translation of JP 8–123073, May 1996.
English language Abstract only of JP 3296771 A.
English language Abstract only of JP 4009865 A.
English language Abstract only of JP 4019754 A.

*Primary Examiner*—Christopher D. Rodee
*Attorney, Agent, or Firm*—Birch, Stewart, Kolasch & Birch, LLP

[57] ABSTRACT

A full color toner for nonmagnetic one-component development usable in a developer device including a developer roller and a blade, the blade serving to regulate a toner layer formed on the developer roller into a uniform thickness and to supply electric charges to toners by triboelectric charging, the full color toner for nonmagnetic one-component development including (a) fine resinous particles including at least a colorant and a binder resin having a polyester resin as a main component; and (b) additives externally applied onto a surface of the fine resinous particles, the additives including inorganic fine particles consisting of positively chargeable, inorganic fine particles and negatively chargeable, inorganic fine particles when subjecting the additives to triboelectric charging with an iron powder.

7 Claims, No Drawings

FULL COLOR TONER FOR NONMAGNETIC ONE-COMPONENT DEVELOPMENT

BACKGROUND OF THE INVENTION

1. Field of the Invention

The present invention relates to a full color toner for nonmagnetic one-component development used for development of electrostatic latent images in electrophotography, electrostatic recordings, electrostatic printing, and the like.

2. Discussion of the Related Art

As disclosed in U.S. Pat. Nos. 2,221,776, 2,297,691 and 2,357,809 and other publications, conventional electrophotography utilized in apparatuses for forming fixed images comprises the steps of forming an electrostatic latent image by evenly charging a photoconductive insulating layer (a charging process) and subsequently exposing the layer to eliminate the charge on the exposed portion (an exposing process) and visualizing the formed image by adhering colored charged fine powder known as a toner to the latent image (a developing process); transferring the obtained visible image to an image-receiving sheet such as a transfer paper (a transfer process); and permanently fixing the transferred image by heating, pressure application or other appropriate means of fixing (a fixing process). The above method may further comprise, subsequent to the transferring of the visible image, scraping off residual toners on the photoconductor for the purpose of cleaning the photoconductor surface (a cleaning process).

Among the above electrophographic methods, in the developing process, there have been proposed, as the most convenient method, two-component magnetic brush development methods using a developer consisting of two components, namely, a toner and a carrier, the carrier being used for the purposes of supplying electric charges to the toner and of conveying the charged toner onto the latent image portion by a magnetic force.

However, in the two-component magnetic brush developing method, since a magnetic force is utilized in the conveying of the developer, a magnet has to be placed in the developer roller, and the carrier is made of a metal or an oxide thereof such as iron powder, nickel powder, and ferrite. Therefore, the developer device and the developer become undesirably heavy, thereby making it difficult to miniaturize and thus reduce the weight of the overall recording device.

In addition, as disclosed, for instance, in U.S. Pat. Nos. 3,909,258 and 4,121,931, there have been conventionally well used magnetic one-component development methods comprising the step of conveying a toner to the electrostatic latent image portion without using a carrier, the methods being carried out by utilizing a magnetic force owned by the toner containing a magnetic substance therein. However, a magnet has to be also used in the inner portion of the developer roll in this development method, making it disadvantageous from the aspect of reducing the weight of the developer device.

In order to solve the problems in these development methods, much studies have been recently conducted and much improvements made on nonmagnetic one-component development methods wherein a toner alone is used without containing any magnetic powder, as disclosed, for instance, in U.S. Pat. Nos. 2,895,847 and 3,152,012, and Japanese Patent Examined Publication Nos. 41-9475, 45-2877 and 54-3624. These development methods are extremely advantageous for miniaturizing and reducing the weight of the recording device from the aspect of using no magnets in the developer roller. Particularly, there are an increased number of cases of using the above development method for such applications as miniaturized printers for personal computers and plain paper facsimiles in which much studies and development have been actively made in the recent years.

However, since the nonmagnetic one-component development method does not utilize a carrier, extremely large difficulty is posed in controlling the amount of the triboelectric charges of the toners. Also, particularly in the case of a full color toner, only colorless charge control agent can be used, thereby making it difficult to maintain good triboelectric chargeability.

Therefore, in order to maintain stable triboelectric chargeability, color toners for nonmagnetic one-component development containing chargeable colorant-containing fine particles and organic fine resinous particles being reversely chargeable thereto when subjecting to triboelectric charging with an iron powder are disclosed, for instance, in Japanese Patent Laid-Open Nos. 3-296771, 4-9865, and 4-19754. However, these toners have problems in that the fine resinous particles are likely to be fused to the charger blade or that the fine resinous particles are likely to form filming on the photoconductor.

Also, Japanese Patent Laid-Open No. 7-27087 discloses a toner to which a silica being subjected to a hydrophobic treatment with a silicone oil is applied in order to obtain a toner with excellent developability, transferability, and stability with a passage of time. However, this toner contributes little to the triboelectric chargeability of the toner, thereby making it difficult to use such a toner in cases of high-performance devices where extremely rapid initial rise in the amount of the triboelectric charges is in demand from the aspects of the level of background and the image quality.

Accordingly, an object of the present invention is to provide a full color toner for nonmagnetic one-component development having excellent triboelectric chargeability.

These and other objects of the present invention will be apparent from the following description.

SUMMARY OF THE INVENTION

As a result of intense studies in view of the above problems, the present inventors found that a good triboelectric chargeability can be maintained by using a toner containing positively chargeable, inorganic fine particles and negatively chargeable, inorganic fine particles, when subjecting the inorganic fine particles to triboelectric charging with an iron powder, thereby making it possible to substantially eliminate problems inherent in the nonmagnetic one-component development by having low level of background, low level of ghost and a little difference in image densities at initial end and terminal end owing to the delay in the initial amount in the triboelectric charges.

Specifically, the present invention is concerned with the following:

(1) A full color toner for nonmagnetic one-component development usable in a developer device comprising a developer roller and a blade, the blade serving to regulate a toner layer formed on the developer roller into a uniform thickness and to supply electric charges to toners by triboelectric charging, the full color toner for nonmagnetic one-component development comprising:
   (a) fine resinous particles comprising at least a colorant and a binder resin comprising a polyester resin as a main component; and
   (b) additives externally applied onto a surface of the fine resinous particles, the additives comprising inorganic fine particles consisting of positively chargeable, inorganic fine particles and negatively chargeable, inorganic fine particles when subjecting the additives to triboelectric charging with an iron powder;

(2) The full color toner for nonmagnetic one-component development described in item (1) above, wherein an amount of triboelectric charges of the positively chargeable, inorganic fine particles is from 10 to 500 $\mu$C/g, and wherein an amount of triboelectric charges of the negatively chargeable, inorganic fine particles is from −10 to −500 $\mu$C/g;

(3) The full color toner for nonmagnetic one-component development described in item (1) above, wherein a weight ratio of the positively chargeable, inorganic fine particles to the negatively chargeable, inorganic fine particles is selected from:
   (a) 90/10 to 50/50, in a case of a positively chargeable toner; and
   (b) 50/50 to 10/90, in a case of a negatively chargeable toner;

(4) The full color toner for nonmagnetic one-component development described in item (1) above, wherein the inorganic fine particles have two distinct ranges of particle sizes:
   one range is 30 nm or more and 100 nm or less; and
   the other range is 20 nm or less, and
   wherein at least one member selected from the positively chargeable, inorganic fine particles and the negatively chargeable, inorganic fine particles has an average primary particle size of 30 nm or more and 100 nm or less, and the remaining members have an average primary particle size of 20 nm or less;

(5) The full color toner for nonmagnetic one-component development described in item (1) above, wherein at least one member selected from the positively chargeable, inorganic fine particles and the negatively chargeable, inorganic fine particles is subjected to hydrophobic treatment with a silicone oil, wherein an amount of the silicone oil applied thereto is 1 to 5 mg/m$^2$ per surface area of the inorganic fine particles;

(6) The full color toner for nonmagnetic one-component development described in item (1) above, wherein a coating ratio by the inorganic fine particles is 30% or more;

(7) The full color toner for nonmagnetic one-component development described in item (1) above, wherein the inorganic fine particles comprise silica fine particles;

(8) The full color toner for nonmagnetic one-component development described in item (1) above, wherein the polyester resin has an acid value of 10 KOH mg/g or more; and (9) The full color toner for nonmagnetic one-component development described in item (1) above, wherein the polyester resin has a glass transition temperature of 55° C. or more.

DETAILED DESCRIPTION OF THE INVENTION

The full color toner for nonmagnetic one-component development of the present invention comprises a developer roller and a blade, the blade serving to regulate a toner layer formed on the developer roller into a uniform thickness and to supply electric charges to toners by triboelectric charging, the full color toner for nonmagnetic one-component development comprising:

(a) fine resinous particles comprising at least a colorant and a binder resin comprising a polyester resin as a main component; and
(b) additives externally applied onto a surface of the fine resinous particles, the additives comprising inorganic fine particles consisting of positively chargeable, inorganic fine particles and negatively chargeable, inorganic fine particles when subjecting the additives to triboelectric charging with an iron powder.

In conventional toners, additives, such as inorganic fine particles of the same polarity, are externally applied onto surfaces of the fine resinous particles to secure good chargeability and free flowability. By contrast, in addition to the inorganic fine particles of the same polarity, the inorganic fine particles of the reversed polarity are added to secure good chargeability and to lower the level of background, the level of ghost, and the difference in image densities at initial end and terminal end which are owing to the delay in the initial amount of triboelectric charges, which have been posing problems in non-magnetic one-component development. Also, no adhesion of the fine resinous particles to the charger blade and no filming of the fine resinous particles to the photoconductor are likely to take place, as found in cases where organic fine particles of reversed polarity are applied.

The inorganic fine particles usable in the present invention may be any of conventionally known materials. Examples thereof include fine particles of silicon dioxide (silica), titanium dioxide (titania), aluminum oxide, zinc oxide, magnesium oxide, cerium oxide, iron oxide, copper oxide, tin oxide, and the like. Among the above inorganic fine particles, from the aspects of easiness in modification and availability, preference is given to silica fine particles.

Concrete examples of commercially available products of the inorganic fine particles which are preferably usable in the present invention include the following:

(a) Silicon dioxide fine particles: products manufactured by Nippon Aerosil Co., Ltd., such as "MOX80" (average particle size: about 30 nm), "OX50" (average particle size: about 40 nm), and "TT600" (average particle size: about 40 nm); and
(b) Titanium oxide fine particles: products manufactured by Idemitsu Kosan Co., Ltd., such as "IT-PB" (average particle size: about 40 nm) and "IT-PC" (average particle size: about 60 nm); and products manufactured by Fuji Titanium Industry Co., Ltd., such as "TAF110A" (average particle size: about 40 nm to about 50 nm) and "TAF510" (average particle size: about 40 nm to about 50 nm). These inorganic fine particles may be used singly or in a combination of two or more kinds.

Among the inorganic fine particles usable in the present invention, it is desired that the inorganic fine particles have two distinct ranges of particle sizes:

one range is 30 nm or more and 100 nm or less; and
the other range is 20 nm or less, and that at least one member selected from the positively chargeable, inorganic fine particles and the negatively chargeable, inorganic fine particles has an average primary particle size of 30 nm or more and 100 nm or less, preferably 30 nm or more and 70 nm or less, and that the remaining members have an average primary particle size of 20 nm or less. By controlling the average primary particle sizes of the positive chargeable or negatively chargeable inorganic fine particles to given ranges, the effects thereof can be well maintained and sufficient free flowability of the toner can be secured. Here, the average particle size is a number-average particle size.

The particle sizes of the inorganic fine particles are determined from an electron micrograph taken by using a scanning electron microscope or a transmission electron microscope.

Also, as another indices, in cases where the inorganic fine particles comprise silica having a true specific gravity of 2.3 $g/cm^3$, the silica having a specific surface area of 20 to 80 $m^2/g$ as determined by BET method corresponds to the above particle size range.

It is desired that the amount of the triboelectric charges of the positively chargeable, inorganic fine particles is from 10 to 500 $\mu C/g$, preferably from 50 to 200 $\mu C/g$, and that the amount of the triboelectric charges of the negatively chargeable, inorganic fine particles is from −10 to −500 $\mu C/g$, preferably from −30 to −200 $\mu C/g$. When the amounts of the triboelectric charges of the positively chargeable and negatively chargeable, inorganic fine particles are respectively controlled within the above ranges, stable triboelectric chargeability can be secured.

The above inorganic fine particles are either positively or negatively charged without any treatment, and in order to more positively charge the inorganic fine particles when subjecting to triboelectric charging with an iron powder, the above inorganic fine particles may preferably be subjected to a hydrophobic treatment with an aminosilane or an amino-modified silicone oil. Also, the inorganic fine particles which are strongly charged positively or negatively may be subjected to hydrophobic treatment with such hydrophobic treatment agents as dichlorodimethylmethane, hexamethyldisilane, a silicone oil, and the like. Incidentally, since the aminosilane is highly hydrophilic, it is preferred that the inorganic fine particles are subjected to a hydrophobic treatment with the aminosilane, and then further subjected to a hydrophobic treatment with a silicone oil, hexamethyldisilane, and the like. Also, among the above hydrophobic treatment agents, preference is given to the silicone oil from the aspect of lowering the level of background. Therefore, it is preferred that at least one member selected from the positively chargeable, inorganic fine particles and the negatively chargeable, inorganic fine particles is subjected to a hydrophobic treatment with the silicone oil.

Concrete examples of the silicone oils usable in the hydrophobic treatment include dimethyl silicone oil, methylphenyl silicone oil, methyl hydrogen silicone oil, alkyl-modified silicone oils, fluoro-modified silicone oils, polyether-modified silicone oils, alcohol-modified silicone oils, amino-modified silicone oils, epoxy-modified silicone oils, epoxy-polyether-modified silicone oils, phenol-modified silicone oils, carboxyl-modified silicone oils, mercapto-modified silicone oils, and the like, each having a viscosity at 25° C. of from 50 to 10000 cSt.

In the present invention, the amount of the silicone oil applied to the inorganic fine particles in the hydrophobic treatment is preferably from 1 to 5 $mg/m^2$ per surface area of the above inorganic fine particles, more preferably from 2 to 3 $mg/m^2$. When the amount of the silicone oil applied to the inorganic fine particles is equal to or higher than the lower limit of the above range, the effects of lowering the level of background by the hydrophobic treatment with the silicone oil can be remarkably noted, and when the amount of the silicone oil applied is equal to or lower than the upper limit of the above range, the agglomeration of the inorganic fine particles can be inhibited, thereby making it possible to uniformly adhere the inorganic fine particles to surfaces of the toner.

In the case of the inorganic fine particles having a specific surface area of 50 $m^2/g$ as determined by BET method, the amount of the silicone oil applied as specified above corresponds to 10 to 15 parts by weight, based on 100 parts by weight of the inorganic fine particles.

The surface area of the inorganic fine particles used herein refers to a specific surface area as determined by BET method, which may be measured by commercially available BET specific surface area analyzer by nitrogen adsorption, by, for instance, using flow-type, specific surface area automatic analyzer (manufactured by Shimadzu Corporation; FLOWSOAP Model 2300), and the like.

The methods of the hydrophobic treatment with a silicone oil are not particularly limited as long as the silicone oil is adsorbed to the surfaces of the inorganic fine particles. Examples of such methods include a method comprising the steps of spraying a mixture comprising a silicone oil diluted by a solvent while stirring the inorganic fine particles in a mixing vessel, and thermally drying in the mixing vessel for a given period of time while continuing to stir the inorganic fine particles.

Concrete examples of commercially available products of the inorganic fine particles subjected to a hydrophobic treatment with a silicone oil which are preferably used in the present invention include positively chargeable, inorganic fine particles, such as "RA200HS" (manufactured by Nippon Aerosil Co., Ltd.; average particle size: about 12 nm), "HVK2150" (manufactured by Wacker Chemical Co.; average particle size: about 13 nm), and the like; and negatively chargeable, inorganic fine particles, such as "R972" (manufactured by Nippon Aerosil Co., Ltd.; average particle size: about 16 nm), "RY200" (manufactured by Nippon Aerosil Co., Ltd.; average particle size: about 12 nm), and the like. These inorganic fine particles may be used alone or in combination of two or more kinds.

The full color toner for nonmagnetic one-component development of the present invention may be preferably prepared by externally applying the inorganic fine particles subjected to a hydrophobic treatment as mentioned above onto the surfaces of fine resinous particles (untreated toner). The fine resinous particles to be used herein comprise at least a binder resin and a colorant, and any of conventional, nonmagnetic one-component toners for electrophotography may be used.

Also, in the present invention, at least one member selected from known inorganic fine particles used without any surface treatments and known inorganic fine particles surface-treated with a hydrophobic treatment agent other than the silicone oils may be used together with the inorganic fine particles subjected to the hydrophobic treatment as described above in amounts so as not to impair the advantageous effects of the present invention.

The binder resin in the fine resinous particles in the present invention comprises a polyester resin as a main component, wherein the amount of the polyester resin used in the binder resin is preferably 70% by weight or more, more preferably 90% by weight or more, from the aspects of maintaining excellent durability of the toner and excellent dispersibility of the pigments.

The polyester resins usable in the present invention can be obtained by the condensation polymerization of polyhydric alcohol components and polycarboxylic acid components, namely the condensation polymerization between a polyhydric alcohol and a polycarboxylic acid, a polycarboxylic ester, or a polycarboxylic acid anhydride.

Concrete examples of the dihydric alcohol components include bisphenol A alkylene oxide adducts, such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, hydrogenated bisphenol A, and other dihydric alcohol components.

Concrete examples of the trihydric or higher polyhydric alcohol components include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, and other trihydric or higher polyhydric alcohol components.

In the present invention, these dihydric alcohol monomers and trihydric or higher polyhydric alcohol monomers may be used singly or in combination.

Examples of the dicarboxylic acid monomers include dicarboxylic acids, such as maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, and malonic acid; alkyl- or alkenyl-substituted succinic acids, the alkyl group having 1 to 20 carbon atoms or the alkenyl group having 2 to 20 carbon atoms, such as n-dodecenylsuccinic acid, n-dodecylsuccinic acid, n-octylsuccinic acid, isooctenylsuccinic acid, and isooctylsuccinic acid, acid anhydrides thereof, esters of lower alkyl groups (1 to 4 carbon atoms) thereof, and other dicarboxylic acid components.

Examples of the tricarboxylic or higher polycarboxylic acid components include 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, Empol trimer acid, acid anhydrides thereof, esters of lower alkyl groups (1 to 4 carbon atoms), and other tricarboxylic or higher polycarboxylic acid components.

In the present invention, these dicarboxylic acid monomers and tricarboxylic or higher polycarboxylic acid monomers may be used singly or in combination.

The polyester resin usable in the present invention may be prepared by carrying out condensation polymerization of an alcohol component and a carboxylic acid component at a temperature of from 180° to 250° C. in an inert gas atmosphere. In this case, additives as esterification catalysts, such as zinc oxide, stannous oxide, dibutyltin oxide, dibutyltin dilaurate, and the like, and polymerization inhibitors, such as hydroquinone monomethyl ether, and the like, may be also optionally added.

It is desired that the polyester resin usable in the present invention has an acid value of 10 KOH mg/g or more, preferably 15 KOH mg/g or more, as determined by a method according to JIS K0070 in order to improve the dispersibility of the colorants.

In addition, it is desired that the polyester resin usable in the present invention has a glass transition temperature of 55° C. or more, preferably 60° C. or more, more preferably from 600 to 70° C. in order to maintain good durability of the toner against the stress applied by the charger blade in the nonmagnetic one-component development.

Other resins usable as binder resins in the present invention include, for instance, homopolymers or copolymers of styrene and styrene derivatives, such as styrene, chlorostyrene, and a-methylstyrene; monoolefins, such as ethylene, propylene, butylene, and isobutylene; vinyl esters, such as vinyl acetate, vinyl propionate, vinyl benzoate, and vinyl butyrate; ethylenic aliphatic monocarboxylic esters, such as methyl acrylate, ethyl acrylate, butyl acrylate, octyl acrylate, dodecyl acrylate, phenyl acrylate, methyl methacrylate, ethyl methacrylate, butyl methacrylate, and dodeceyl methacrylate; vinyl ethers, such as vinyl methyl ether, vinyl ethyl ether, and vinyl butyl ether; vinyl ketones, such as vinyl methyl ketone, vinyl hexyl ketone, and vinyl isopropenyl ketone.

In addition, natural or synthetic waxes, polyamides, epoxy resins, polycarbonates, polyurethanes, silicone resins, fluororesins, petroleum resins, and the like may be further added.

Examples of the colorants used in the fine resinous particles in the present invention include carbon black; acetoacetic arylamide-based monoazo yellow pigments, such as C.I. Pigment Yellow 1, C.I. Pigment Yellow 3, C.I. Pigment Yellow 74, C.I. Pigment Yellow 97, and C.I. Pigment Yellow 98; acetoacetic arylamide-based bisazo yellow pigments, such as C.I. Pigment Yellow 12, C.I. Pigment Yellow 13, C.I. Pigment Yellow 14, and C.I. Pigment Yellow 17; yellow dyes, such as C.I. Solvent Yellow 19, C.I. Solvent Yellow 77, C.I. Solvent Yellow 79, and C.I. Disperse Yellow 164; red or crimson pigments, such as C.I. Pigment Red 48, C.I. Pigment Red 49:1, C.I. Pigment Red 53:1, C.I. Pigment Red 57, C.I. Pigment Red 57:1, C.I.

Pigment Red 81, C.I. Pigment Red 122, and C.I. Pigment Red 5; red dyes, such as C.I. Solvent Red 49, C.I. Solvent Red 52, C.I. Solvent Red 58, and C.I. Solvent Red 8; blue pigments and dyes of copper phthalocyanine and derivatives thereof, such as C.I. Pigment Blue 15:3; green pigments, such as C.I. Pigment Green 7 and C.I. Pigment Green 36 (Phthalocyanine Green). These colorants may be used alone or in combination. These colorants are preferably added in an amount of from about 1 to 15 parts by weight, based on 100 parts by weight of the binder resin.

The fine resinous particles in the present invention may contain charge control agents, and the usable charge control agents include negative charge control agents and positive charge control agents. Examples of the negative charge control agents include chromium complexes of azo dyes; iron complexes of azo dyes; cobalt complexes of azo dyes; chromium, zinc, aluminum or boron complexes of salicylic acid or derivatives thereof, or complex salt compounds thereof; chromium, zinc, aluminum or boron complexes of 1-hydroxy-2-naphtholic acid or derivatives thereof, or complex salt compounds thereof; chromium, zinc, aluminum or boron complexes of benzylic acid or derivatives thereof, or complex salt compound thereof; surfactants such as long-chain-alkylcarboxylates and long-chain-alkylsulfonates.

Examples of the positive charge control agents include nigrosine dyes and derivatives thereof; triphenylmethane derivatives; derivatives of such salts as quaternary ammonium salts, quaternary phosphonium salts, quaternary pyridinium salts, guanidine salts, and amidine salts.

Further, in the production of the fine resinous particles, property improvers, for instance, offset inhibitors including waxes, such as polyolefins, may be also optionally added. When the polyester resin in the present invention is used as the binder resin, these property improvers may not be necessary. Even if they are used, they are added in a small amount.

The fine resinous particles of the present invention may be prepared by such methods as kneading and pulverization methods, spray-drying methods, polymerization methods, and the like. The fine resinous particles of the present invention can be generally obtained by the steps of uniformly dispersing a binder resin, a colorant, a wax, a charge control agent, and the like using a known mixer; melt-kneading the mixture in a sealed kneader, or a single-screw or twin-screw extruder, cooling, pulverizing, and then classifying by known methods. The kneaders recently most well used is a single-screw or twin-screw extruder, from the aspect of such advantages as capability of continuous, mass production, and concrete examples thereof include "Model KTK" TWIN-SCREW EXTRUDER (manufactured by Kobe Steel, Ltd.), "Model TEM" EXTRUDER (manufactured by Toshiba Machine Co., Ltd.), TWIN-SCREW EXTRUDER (manufactured by K.C.K.), "Model PCM" TWIN-SCREW EXTRUDER (manufactured by Ikegai Tekkosho), Buss Ko-kneader (manufactured by Buss (Japan) Ltd.), and the like.

The resulting fine resinous particles have an average particle size of preferably 20 $\mu$m or less, more preferably from 3 to 20 $\mu$m. Incidentally, the average particle size measured herein is a volume-average particle size.

In the resulting full color toner of the present invention, the inorganic fine particles described above are externally applied onto the surfaces of the fine resinous particles prepared above. The methods of external application treatment described above may be, for instance, carried out by stirring and blending the classified fine resinous particles and the inorganic fine particles externally applied to the surfaces thereof by using a high-performance mixer, including a Supermixer, a Henschel mixer, and the like. Also, the mixing conditions, such as agitation rotational speed, mixing time, and the like, may be determined as appropriate depending upon the properties of the toner. Also, it is further preferred that the inorganic fine particles are previously subjected to disintegration treatment.

The coating ratio by the inorganic fine particles is preferably 30% or more, more preferably from 30 to 60% in order to increase the effects of giving the free flowability, to thereby give excellent transferability. In addition, the mixing ratios (weight ratios) of the positively chargeable, inorganic fine particles to the negatively chargeable, inorganic fine particles may be as follows.

(a) In the case of making a positively chargeable toner, the weight ratio of the positively chargeable, inorganic fine particles to the negatively chargeable, inorganic fine particles is preferably from 90/10 to 50/50, more preferably from 80/20 to 60/40.

(b) In the case of making a negatively chargeable toner, the weight ratio of the positively chargeable, inorganic fine particles to the negatively chargeable, inorganic fine particles is preferably from 50/50 to 10/90, preferably from 40/60 to 20/80.

Here, in the present invention, in the case where silica, for instance, is used as the inorganic fine particles, the silica in a partially agglomerated state may be applied onto the surfaces of the fine resinous particles. The actual coating ratio is lower than the calculated value given below.

The coating ratio (f) in the present invention is calculated by the following equation:

$$f(\%) = \frac{\sqrt{3}}{2\pi} \times \frac{(D \cdot \rho_\tau)}{(d \cdot \rho_s)} \times C \times 100$$

wherein d stands for a particle size of the inorganic fine particles; D stands for a particle size of the fine resinous particles; $\rho_\tau$ and $\rho_s$ respectively stand for a true specific gravity of the fine resinous particles and a true specific gravity of the inorganic fine particles; and C is a weight ratio of the inorganic fine particles to the fine resinous particles.

In the present invention, since both the positively chargeable, inorganic fine particles and the negatively chargeable, inorganic fine particles are externally applied onto surfaces of the fine resinous particles, the coating ratio (f) in the overall toner is a total sum of the coating ratios of each of the inorganic fine particles. For instance, in the case where inorganic fine particles (1) and inorganic fine particles (2) are externally applied, the coating ratios (f) of the overall toner is equal to $f_1+f_2$, wherein $f_1$ and $f_2$ respectively stand for a coating ratio for the inorganic fine particles (1) and a coating ratio for the inorganic fine particles (2).

The full color toner for nonmagnetic one-component development of the present invention described above is suitably used for a developer device comprising a developer roller and a blade, the blade serving to regulate the toner layer formed on the developer roller into a uniform thickness and to supply electric charges to the toner by triboelectric charging.

EXAMPLES

The present invention will be explained in detail by means of the following working examples, without intending to limit the scope of the present invention thereto.

Here, the softening points, the glass transition temperatures (Tg), and the acid values of the resulting resins are measured by the following methods.

Softening Point

Measured by a method according to ASTM E28-67.

Glass Transition Temperature (Tg)

The glass transition temperature (Tg) refers to the temperature of an intersection of the extension of the baseline of not more than the glass transition temperature and the tangential line showing the maximum inclination between the kickoff of the peak and the top thereof as determined with a sample using a differential scanning calorimeter ("DSC Model 210," manufactured by Seiko Instruments, Inc.), at a heating rate of 10° C./min. The sample is treated before measurement using the DSC by raising its temperature to 100° C., keeping at 100° C. for 3 minutes, and cooling the hot sample at a cooling rate of 10° C./min. to room temperature.

Acid Value

Measured by a method according to JIS K0070.

Preparation Example 1 of Binder Resin (1)

A reaction vessel equipped with a stirring device, a reflux condenser with a cooling tube for cooling and removing the water formed during reaction, and a nitrogen inlet tube was charged with 350.0 parts by weight of polyoxypropylene (2.2)-2,2-bis(4-hydroxyphenyl)propane, 116.0 parts by weight of fumaric acid, and 0.2 parts by weight of hydroquinone monomethyl ether. The reaction vessel was placed in a mantle heater, and the contents were gradually heated to carry out dehydration condensation reaction at 210° C. under a nitrogen gas stream, to give a polyester resin having a softening point of 101.6° C., a glass transition temperature of 61.5° C., and an acid value of 19.8 KOH mg/g. This resin is referred to as "Binder Resin (1)."

Preparation Example 1 of Untreated Toner (A)

| | |
|---|---|
| Binder Resin (1) | 100 parts by weight |
| Charge Control Agent "LR-147" (manufactured by Japan Carlit Co., Ltd.) | 1 part by weight |
| Cyan Pigment "C.I. PIGMENT BLUE 15:3" | 5 parts by weight |

The materials having the above composition were blended with a Henschel mixer in advance, and the obtained mixture was melt-kneaded using a twin-screw extruder. After cooling the extruded product, the cooled product was roughly pulverized and then finely pulverized by a jet mill. The pulverized product was further classified to give an untreated toner (A) having an average particle size of 8 μm.

Preparation Example 2 of Untreated Toner (B)

| | |
|---|---|
| Binder Resin (1) | 100 parts by weight |
| Charge Control Agent "LR-147" (manufactured by Japan Carlit Co., Ltd.) | 1 part by weight |
| Yellow Pigment "C.I. PIGMENT YELLOW 14" | 5 parts by weight |

The materials having the above composition were blended with a Henschel mixer in advance, and the obtained mixture was melt-kneaded using a twin-screw extruder. After cooling the extruded product, the cooled product was roughly pulverized and then finely pulverized by a jet mill. The pulverized product was further classified to give an untreated toner (B) having an average particle size of 8 μm.

Preparation of Inorganic Fine Particles

Inorganic Fine Particles 1) to 3) in Table 1 to be externally applied onto surfaces of the toners were prepared by subjecting the starting material inorganic fine particles shown in Table 1 to a hydrophobic treatment using a silicone oil. Inorganic Fine Particles 4) to 6) in Table 1 to be externally applied onto surfaces of the toners were commercially available products given below, each of which were subjected to hydrophobic treatment:

4) "R972" (manufactured by Nippon Aerosil Co., Ltd.)

5) "RA200HS" (manufactured by Nippon Aerosil Co., Ltd.)

6) "HVK2150" (manufactured by Wacker Chemical Co.)

TABLE 1

| Type of Inorganic Fine Particles | Starting Material Inorganic Fine Particles | Particle size (nm) | Treatment Agent | Amount of Treatment Agent Applied ($mg/m^2$) | Amount of Triboelectric Charges with Iron Powder (μC/g) |
|---|---|---|---|---|---|
| 1) | Silicon dioxide | 40 | Silicone oil | 2.0 | −100 |
| 2) | Silicon dioxide | 40 | Silicone oil | 3.0 | −70 |
| 3) | Titanium dioxide | 50 | Silicone oil | 3.0 | −5.0 |

TABLE 1-continued

| Type of Inorganic Fine Particles | Starting Material Inorganic Fine Particles | Particle size (nm) | Treatment Agent | Amount of Treatment Agent Applied (mg/m$^2$) | Amount of Triboelectric Charges with Iron Powder ($\mu$C/g) |
|---|---|---|---|---|---|
| 4) | R972 | 16 | — | — | −380 |
| 5) | RA200HS | 12 | — | — | +100 |
| 6) | HVK2150 | 13 | — | — | +150 |

Incidentally, the hydrophobic treatment of the inorganic fine particles and the amount of triboelectric charges are measured by the following methods.

Hydrophobic Treatment

One-hundred parts by weight of the starting material inorganic fine particles are stirred in a mixing vessel. A hydrophobic treatment agent is diluted with a necessary amount of the solvent, and the treatment agent solution is sprayed to the inorganic fine particles in the mixing vessel. Thereafter, the mixing vessel is heated to a temperature of 105° C. while stirring, and the temperature is maintained at 105° C. for two hours. Subsequently, the treated fine particles are cooled, and then taken out from the vessel.

Amount of Triboelectric Charges

A test sample is prepared by weighing and placing 0.01 g of inorganic fine particles and 9.99 g of iron carrier having a particle size of from 100 to 200 mesh-pass in a glass container having 20 cc capacity, and stirring the components for ten minutes at 250 rpm using a ball-mill.

The amount of triboelectric charges is measured by a blow-off type electric charge measuring device equipped with a hand-made Faraday cage, a capacitor and an electrometer as described below. First, W (g) of the test sample prepared above is placed into a brass measurement cell equipped with a stainless screen of 400 mesh. Next, after aspirating from a suction opening for five seconds, blowing is carried out for five seconds under a pressure indicated by a barometric regulator of 0.6 kgf/cm$^2$, thereby selectively removing only the inorganic fine particles from the cell.

In this case, the voltage of the electrometer after two seconds from the start of blowing is defined as V (volt). Here, when the electric capacitance of the capacitor is defined as C ($\mu$F), the amount of triboelectric charges of the inorganic fine particles can be calculated by the following equation:

$$\text{Amount of Triboelectric Charges } (\mu C/g)=(C\times V)/0.001W$$

Examples 1 to 5 and Comparative Examples 1 to 3

Each of the toners was prepared by externally applying the inorganic fine particles in proportions shown in Table 2, based on 100 parts by weight of Untreated Toner (A) or Untreated Toner (B), and blending the components with a Henschel mixer. The coating ratio is also shown in Table 2.

TABLE 2

| | Untreated Toner | Kind of Inorganic Fine Particles and Amount Applied (parts by weight) | Coating Ratio (%) |
|---|---|---|---|
| Example Nos. | | | |
| 1 | (A) | 1): 1.0<br>5): 0.3 | 60.2 |
| 2 | (B) | 1): 1.0<br>5): 0.3 | 60.2 |
| 3 | (A) | 1): 1.0<br>6): 0.3 | 57.9 |
| 4 | (A) | 2): 1.0<br>5): 0.3 | 60.2 |
| 5 | (A) | 3): 1.0<br>5): 0.3 | 42.7 |
| Comparative Example Nos. | | | |
| 1 | (A) | 1): 1.0<br>4): 0.3 | 52.7 |
| 2 | (A) | 1): 1.0 | 30.1 |
| 3 | (A) | 5): 1.0 | 30.1 |

Test Example 1

Each of toner prepared in Examples 1 to 5 and Comparative Examples 1 to 3 was loaded to a commercially available recording device for full color electrophotography for non-magnetic one-component development equipped with a developer roller having a 15 mm diameter, and the image density, the amount of triboelectric charges on the developer roller, the background on photoconductor, the level of ghost, and the difference in the image density at initial end and terminal end were evaluated by each of the methods detailed below. The results are shown in Table 3.

(1) Image Density

Measured by using a Macbeth reflective densitometer ("RD914" manufactured by Macbeth Process Measurements Co.).

(2) Amount of Triboelectric Charges on Developer Roller

Each of the amounts of triboelectric charges is measured by a blow-off type electric charge measuring device equipped with a Faraday cage, a capacitor, and an electrometer as described below. First, W (g) (about 0.15 to 0.20 g) of the toner prepared above is placed into a brass measurement cell equipped with a stainless screen of 500 mesh. Next, after aspirating from a suction opening for 5 seconds, blowing is carried out for 5 seconds under a pressure indicated by a barometric regulator of 0.6 kgf/cm$^2$, thereby selectively removing only the toner from the cell.

In this case, the voltage of the electrometer after 2 seconds from the start of blowing is defined as V (volt). Here, when the electric capacitance of the capacitor is defined as C ($\mu$F), the triboelectric charge Q/m of this toner can be calculated by the following equation:

$$Q/m\ (\mu C/g)=C\times V/m$$

Here, since the toner is a toner for nonmagnetic one-component development, m is equal to W, the weight of the toner.

(3) Background on Photoconductor

Evaluated by taking out the images formed on the photoconductor using a mending tape, measuring an X-value (cyan) and a Z-value (yellow) using a color and color difference meter "CR-221" (manufactured by Minolta Camera Co., Ltd.), and calculating the percentage from each of the respective X-values and Z-values of the mending tapes before and after testing.

(4) Level of Ghost

Measured by obtaining differences between the image density at initial end of the formed image (image formed at first rotation of developer roller) and the image density of the image formed at the second rotation of the developer roller when printing solid images, the image density being measured by using a Macbeth reflective densitometer ("RD914" manufactured by Macbeth Process Measurements Co.).

In the table, each of the ranks correspond to the following evaluation standards:

A: ΔID<0.05;

B: 0.05≦ΔID<0.1;

C: 0.1≦ΔID<0.3; and

D: ΔID≧0.3.

Here, ΔID denotes a difference between the image density of the image formed at first rotation and the image density of the image formed at second rotation.

(5) Difference in Image Densities at Initial End and Terminal End

Measured by obtaining differences between the image density at initial end of the formed image (image formed at second rotation of developer roller) and the image density at terminal end (image formed after printing 25 cm from the initial end of the page) when printing solid images, the image density being measured by using a Macbeth reflective densitometer ("RD914" manufactured by Macbeth Process Measurements Co.).

In the table, each of the ranks correspond to the following evaluation standards:

A: ΔID<0.1;

B: 0.1≦ΔID<0.3;

C: 0.3≦ΔID<0.5; and

D: ΔID≧0.5.

Here, ΔID denotes a difference between the image density of the image formed at initial end and the image density of the image formed at terminal end.

TABLE 3

| | Image Density | Amount of Triboelectric Charges on Developer Roller (μC/g) | Level of Background on Photoconductor | Level of Ghost | Difference of Image Densities at Initial End and Terminal End |
|---|---|---|---|---|---|
| Example Nos. | | | | | |
| 1 | 1.68 | −19.8 | −1.3 | A | B |
| 2 | 1.80 | −20.6 | −0.9 | A | A |
| 3 | 1.75 | −23.0 | −1.5 | A | A |
| 4 | 1.64 | −15.5 | −1.0 | B | B |
| 5 | 1.75 | −17.5 | −1.8 | A | A |
| Comparative Example Nos. | | | | | |
| 1 | 1.68 | −12.0 | −4.9 | D | D |
| 2 | 1.61 | −9.2 | −6.5 | C | C |
| 3 | 1.52 | −17.3 | −9.5 | C | C |

As is shown in Table 3, although not a significant difference is observed in the image densities between Examples and Comparative Examples, toners of Examples have remarkably larger amounts of triboelectric charges and remarkably lower levels of background on photoconductor as compared to toners of Comparative Examples. Therefore, it is made possible to obtain excellent image quality by using toners of Examples.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A color toner for nonmagnetic one-component development usable in a developer device comprising a developer roller and a blade, the blade serving to regulate a toner layer formed on the developer roller into a uniform thickness and to supply electric charges to toners by triboelectric charging, the color toner for nonmagnetic one-component development comprising:

(a) fine resinous particles comprising at least a colorant and a binder resin comprising a polyester resin as a main component; and (b) additives externally applied onto a surface of the fine resinous particles, said additives comprising inorganic fine particles consisting of positively chargeable, inorganic fine particles and negatively chargeable, inorganic fine particles, wherein one of said inorganic fine particles has an average particle size in the range of 30 nm to 100 nm, and another of said inorganic fine particles has an average particle size in the range of 20 nm or less, wherein an amount of triboelectric charges of the positively chargeable, inorganic fine particles is from 50 to 200 $\mu$C/g, and wherein an amount of triboelectric charges of the negatively chargeable, inorganic fine particles is from −10 to −500 $\mu$C/g.

2. The color toner for nonmagnetic one-component development according to claim 1, wherein a weight ratio of the positively chargeable, inorganic fine particles to the negatively chargeable, inorganic fine particles is selected from the group consisting of:

(a) 90/10 to 50/50, in a case of a positively chargeable toner, and (b) 50/50 to 10/90, in a case of a negatively chargeable toner.

3. The color toner for nonmagnetic one-component development according to claim 1, wherein at least one member selected from the group consisting of the positively chargeable, inorganic fine particles and the negatively chargeable, inorganic fine particles is subjected to hydrophobic treatment with a silicone oil, wherein an amount of the silicone oil applied thereto is 1 to 5 mg/m$^2$ per surface area of the inorganic fine particles.

4. The color toner for nonmagnetic one-component development according to claim 1, wherein a coating ratio by the inorganic fine particles is 30% or more.

5. The color toner for nonmagnetic one-component development according to claim 1, wherein said inorganic fine particles comprise silica fine particles.

6. The color toner for nonmagnetic one-component development according to claim 1, wherein said polyester resin has an acid value of 10 KOH mg/g or more.

7. The color toner for nonmagnetic one-component development according to claim 1, wherein said polyester resin has a glass transition temperature of 55° C. or more.

* * * * *